United States Patent [19]

Gerber et al.

[11] 4,380,944

[45] Apr. 26, 1983

[54] METHOD FOR CUTTING SHEET MATERIAL WITH VARIABLE GAIN CLOSED LOOP

[75] Inventors: H. Joseph Gerber; Leonard G. Rich, both of West Hartford, Conn.

[73] Assignee: Gerber Garment Technology, Inc., South Windsor, Conn.

[21] Appl. No.: 229,760

[22] Filed: Jan. 29, 1981

Related U.S. Application Data

[62] Division of Ser. No. 73,871, Sep. 10, 1979, Pat. No. 4,331,051.

[51] Int. Cl.[3] ..... D06H 7/00; B26D 1/10

[52] U.S. Cl. ..... 83/49; 83/56; 83/71; 83/74; 83/747; 83/925 CC

[58] Field of Search ..... 83/71, 74, 75, 747, 83/756, 925 CC, 56, 49

[56] References Cited

U.S. PATENT DOCUMENTS 4,133,234 1/1979 Gerber ..... 83/74 X 4,133,235 1/1979 Gerber ..... 83/74

*Primary Examiner*—James M. Meister

*Attorney, Agent, or Firm*—McCormick, Paulding & Huber

[57] ABSTRACT

A method for cutting limp sheet material with a rigid, cantilevered blade that is reciprocated as it advances along a cutting path through sheet material employs a load sensor to measure lateral loads applied to the blade by the sheet material during cutting. A load signal from the sensor is applied to the blade controls through a variable gain feedback circuit and causes the blade to be oriented slightly toward the side of the cutting path from which an unbalanced load is applied. The adjustment of the gain in the feedback network is made by means of speed sensors which measure the rate at which the cutting blade advances through the sheet material and adjust the feedback gain in inverse relationship.

8 Claims, 9 Drawing Figures

FIG. 5
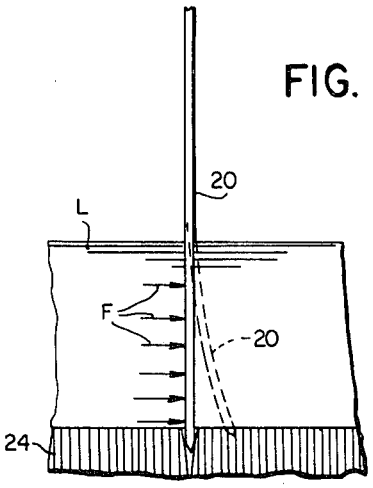
FIG. 7
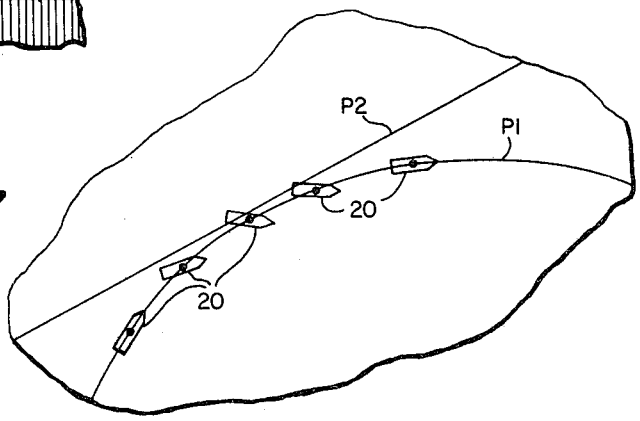
FIG. 6
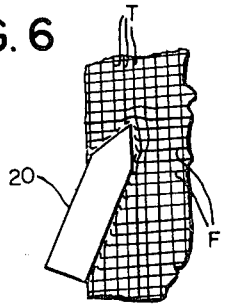
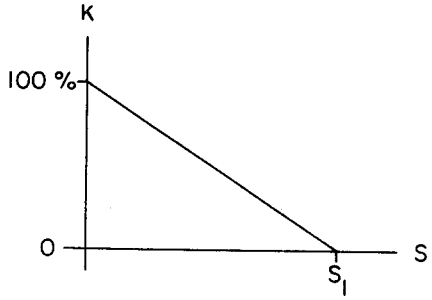
FIG. 8
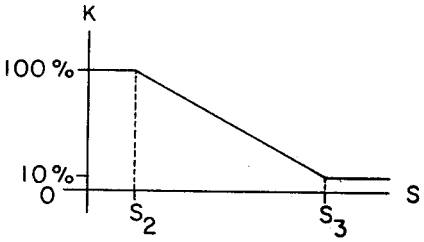
FIG. 9

METHOD FOR CUTTING SHEET MATERIAL WITH VARIABLE GAIN CLOSED LOOP

This is a division of application Ser. No. 73,871, filed Sept. 10, 1979, now U.S. Pat. No. 4,331,051.

BACKGROUND OF THE INVENTION

The present invention relates to a method for cutting limp sheet material with closed loop control. More particularly, the present invention relates to an automatically controlled cutting machine having a rigid, cantilever-mounted knife blade which advances along a cutting path through the sheet material and which is oriented slightly out of a position of tangency by means of a lateral load sensor to oppose loads that bend the blade out of its desired cutting position.

U.S. Pat. No. 4,133,235 issued Jan. 9, 1979 and having the same assignee as the present invention discloses a method and apparatus for cutting limp sheet material for garments, upholstery and other items. The disclosed machine utilizes a reciprocated knife blade that is mounted in cantilever fashion from a tool carriage and which is advanced along a cutting path under programmed control in cutting relationship with a stack or layup of the sheet material. During the cutting operation the depending end of the knife blade penetrates through the stack of material, and loads developed by the interaction of the blade and material operate on the blade. Lateral loads cause the depending end of the knife blade to bend which produces cutting errors regardless of the accuracy with which the upper end of the blade has been positioned by drive motors moving the tool carriage.

To correct the cutting error created by lateral loads, a sensor measures the loads applied to the blade, and through a feedback circuit orients or yaws the blade slightly out at a position tangent to the cutting path and toward the side of the cutting path from which an unbalanced load is applied. The reorientation as the knife blade advances along the cutting path has the effect of opposing the lateral loads and results in more accurate cutting of the limp sheet material.

It has been found that at high cutting rates, that is when the cutting blade and the sheet material are fed relative to one another at high speeds, the loads applied to the cutting blade reach higher levels than at lower cutting speeds, and as a consequence the corrective orientations of the blade are too severe. Under these circumstances the blade is overdriven and a wavy line of cut is generated along cutting paths which should otherwise be straight or have a smooth, gradual curve.

It has additionally been determined that although a reduction in the amount of corrective orientation eliminates the wavy cutting along high speed sections of the cutting path, a corresponding deficiency develops in other critical cutting situations when the corrective orientation is needed at low speeds. For example, at the tangency of two cutting paths, a relatively large amount of yawing is required to prevent the cutting blade from jumping into the adjacent cutting path when the second cut is being made through the point of tangency.

Accordingly,it has been determined that the variation in lateral force levels experienced at different cutting speeds interferes with closed loop control of blade orientation by means of a lateral load sensor. It is accordingly a general object of the present invention to overcome this problem and to obtain high accuracy cutting with a knife blade under a wide variety of cutting circumstances. More particularly, it is an object of the present invention to obtain more accurate cutting over a broad range of cutting speeds.

SUMMARY OF THE INVENTION

The present invention resides in a method for controlling the cutting of sheet material in automatically controlled machines. The machine which carries out the method in one embodiment has a cutting blade which advances through the sheet material along a cutting path by means of drive motors and associated controls which determine the motions of the blade. The motors control not only the speed of the blade along the path but also the orientation of the blade relative to the path.

Load sensing means is operatively associated with the cutting blade and material for detecting lateral loads applied to the blade by the material during cutting. The sensing means, preferably connected with the blade, generates load signals representative of the lateral loads which deflect the blade off of the desired line of cut in the material.

Feedback means couples the load signals from the sensor to the motor controls for adjusting the blade orientation, and in particular, orients the blade toward the side of the cutting path from which an unbalanced load is applied. The degree of orientation depends upon the detected load but causes the loads to be reduced as the blade advances along the cutting path. In accordance with the present invention the feedback means has a variable gain to adjust the effect of the lateral load signal.

Gain adjustment means is connected with the feedback means for adjusting variable gain in accordance with the speed at which the blade advances through the material. In particular the gain is reduced at higher cutting speeds or feed rates so that less corrective orientation occurs. Conversely, at lower speeds the corrective orientation is increased so that an inverse relationship is established between the gain of the feedback means and the cutting speed.

Adjustment of the feedback gain as a function of the cutting speed permits the blade to advance at high speeds along relatively straight or gently curved sections of a pattern without producing a wavy cut due to high load factors. At low speeds when critical cutting situations are more likely to be encountered, the gain of the feedback means is increased so that the cutting blade makes more severe corrective rotations when needed. Thus, the overall cutting operation is improved by establishing an inverse relationship between cutting speed and the load signal gain.

BRIEF DESCRIPTION OF THE DRAWINGS

FIG. 5 is a schematic cross sectional view of the cutting blade in a sheet material layup and illustrates the effect of lateral loading on the blade.

FIG. 6 is a schematic plan view of the cutting blade as it moves through woven sheet material at an angle to the fibers.

FIG. 7 is a schematic plan view of the cutting blade at several locations along the cutting path and illustrates the orientation of the cutting blade which is produced by the lateral load sensor.

FIG. 8 is a diagram illustrating the inverse relationship of closed loop gain and cutting speed in one embodiment of the invention.

FIG. 9 is a diagram illustrating the inverse relationship of closed loop gain and cutting speed in another embodiment of the invention.

DESCRIPTION OF THE PREFERRED EMBODIMENTS

Figure 1:
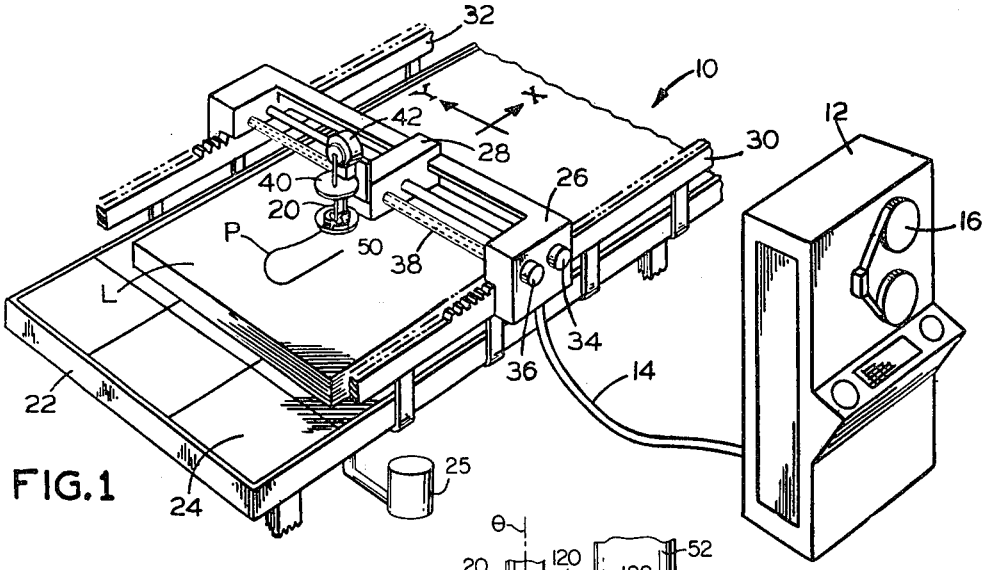
FIG. 1 is a perspective view of an automatically controlled cutting machine in which the present invention is employed.

FIG. 1 illustrates an automatically controlled cutting machine, generally designated 10, of the type in which the present invention may be employed. The cutting machine 10 cuts pattern pieces in a marker from a single or multi-ply layup L of limp sheet material formed by woven or non-woven fabrics, paper, cardboard, leather, synthetics or other materials. The illustrated machine is a numerically controlled cutting machine having a control or computer 12 serving the function of a data processor, a reciprocated cutting blade 20, and a cutting blade 22 having a penetrable vacuum bed 24 defining a support surface on which the layup is spread. From a program tape 16, the computer 12 reads the digitized data defining the contours of the pattern pieces to be cut, and from an internally stored cutting machine program generates machine commands that are transmitted to the cutting table by means of a control cable 14. Signals generated at the table as described in greater detail below are also transmitted from the table back to the computer 12 through the cable. While a program tape has been illustrated as the basic source of cutting data, it will be appreciated that other digital or analog data input devices, such as a line follower illustrated and described in U.S. Pat. No. 4,133,234 entitled Method and Apparatus for Cutting Sheet Material with Improved Accuracy may be employed with equal facility.

The penetrable vacuum bed 24 may be comprised of a foamed material or preferably bristles having upper, free ends defining the support surface of the table. The bristles can be penetrated by the reciprocated cutting blade 20 without damage to either the blade or table as a cutting path P is traversed in the layup. The bed employs a vacuum system including the vacuum pump 25 as described and illustrated in greater detail in U.S. Pat. Nos. 3,495,492 and 3,765,289 having the same assignee as the present invention.

Figure 3:
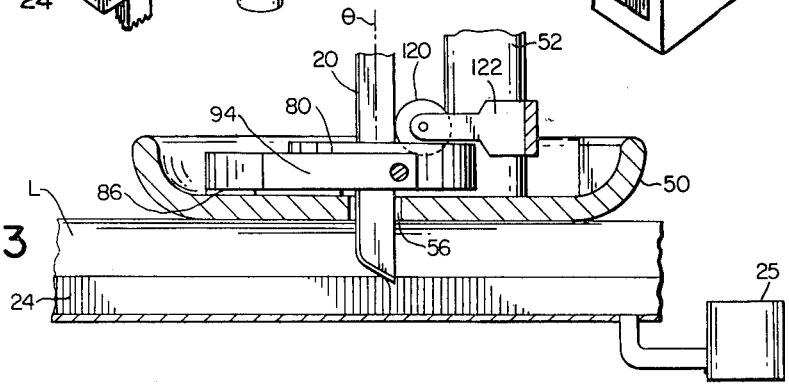
FIG. 3 is a fragmentary side elevation view of the cutting table, blade and presser foot and illustrates a portion of the sensor for measuring lateral loads applied to the blade.

Although not shown in FIG. 1, an air impermeable overlay, may be positioned over the multi-ply layup L to reduce the volume of air drawn through the layup. The vacuum system then evacuates air from the bed 24 and the layup L as shown in FIG. 3 in order to make the layup more rigid and to compress or compact the layup firmly in position on the table at least in the zone where the cutting tool operates. A rigidized layup tends to react to the cutting blade more uniformly and hence is "normalized". A rigidized layup also improves the performance of the present invention as described in greater detail below.

The reciprocated cutting blade 20 is suspended above the support surface of the table by means of the X-carriage 26 and Y-carriage 28. The X-carriage 26 translates back and forth in the illustrated X-coordinate direction on a set of racks 30 and 32. The racks are engaged by pinions (not shown) rotated by an X-drive motor 34 in response to machine command signals from the computer 12. The Y-carriage 28 is mounted on the X-carriage 26 for movement relative to the X-carriage in the Y-coordinate direction and is translated by the Y-drive motor 36 and a lead screw 38 connecting the motor with the carriage. Like the drive motor 34, the drive motor 36 is energized by machine command signals from the computer 12. Coordinated movements of the carriages 26 and 28 are produced by the computer in response to the digitized data taken from the program tape 16 to translate the reciprocating cutting blade 20 along a cutting path P.

The cutting blade 20 is a rigid knife blade suspended in cantilever fashion from a rotatable platform 40 attached to the projecting end of the Y-carriage 28. The platform and the cutting blade are rotated about a $\theta$-axis (FIG. 3) extending longitudinally through the blade perpendicular to the sheet material by means of a $\theta$-drive motor 44 (shown in FIG. 2) which is also controlled from the computer 12. The motor 44 and rotatable platform serve the function of orienting the cutting blade at each point along the cutting path P. The rotatable platform 40 is vertically adjustable and elevates the sharp, leading cutting edge of the blade into and out of cutting engagement with sheet material on the table. An elevation motor (not shown) for moving the platform is also controlled by the computer 12. The cutting blade is also reciprocated by means of a stroking motor 42 supported above the platform 40. For a more detailed description of a blade driving and supporting mechanism, reference may be had to U.S. Pat. No. 3,955,458 issued to the assignee of the present invention.

Figure 4:
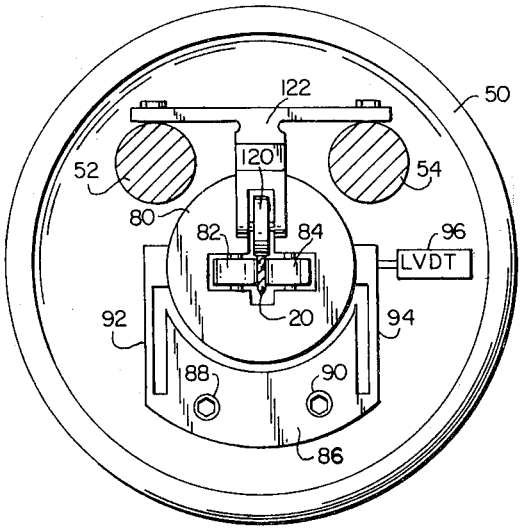
FIG. 4 is a top plan view of the presser foot in FIG. 3 and illustrates the sensor for measuring lateral loads applied to the cutting blade.

A presser foot 50 shown in greater detail in FIGS. 3 and 4 is suspended from the rotatable platform 40 by means of two vertical posts 52 and 54 which are slidably connected with the platform so that the presser foot rests upon the upper ply of the layup under its own weight during cutting. The presser foot surrounds the cutting blade 20 and has a central slot 56 through which the blade reciprocates. The cutting blade and the foot rotate together about the $\theta$-axis with the platform 40, and, therefore, the same positional relationship between the blade and the foot is maintained at all times. Accordingly, the sharp, cutting edge of the blade and the flat trailing edge are aligned in a central plane of the foot between the support posts 52 and 54, and the posts are always disposed rearwardly of the blade as it advances along a cutting path P.

Figure 2:
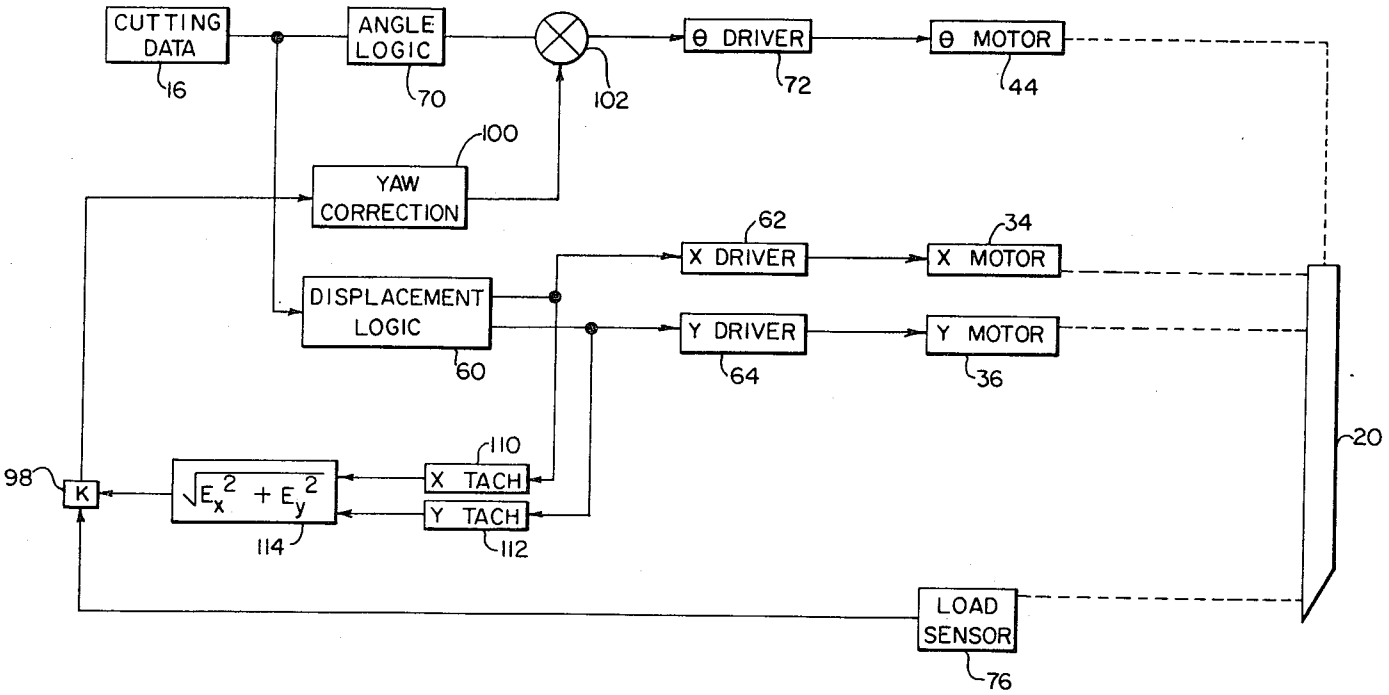
FIG. 2 is a schematic diagram illustrating a closed loop control system in which lateral loads applied to a cutting blade are used to control blade orientation.

FIG. 2 illustrates a control system for the automatically controlled machine 10. Cutting data on the program tape 16 or from another source is utilized by the cutting machine program stored in the computer 12 to generated basic or fundamental machine commands which operate the X-drive motor 34 and Y-drive motor 36 and translate the cutting blade relative to the sheet material layup along a predetermined cutting path. Translational commands which advance the cutting blade relative to the sheet material are generated by displacement logic circuits 60 and are transmitted in the form of digital or analog signals to the X- and Y-drive motors 34 and 36 through X- and Y-drivers or amplifiers 62 and 64 respectively. The signals transmitted to the amplifiers from the circuit 60 also establish the rate at which the motors 34 and 36 are driven and the resultant speed of the blade along the cutting path through the sheet material. In one embodiment of the invention the signals may be digital motor pulses in pulse trains, each pulse representing an increment of displacement along one of the X- or Y-coordinate axes and the pulse repetition frequency representing the rate or speed of movement along the axis.

In addition, in this embodiment of the invention, the angle logic circuits 70 receive cutting data and develop fundamental digital or analog signals which are transmitted through a summing junction 102 to the $\theta$-drive motor 44 by means of a $\theta$-driver or amplifier 72. Alternately, the angle logic circuits may calculate the fundamental signals from displacement information supplied by the circuits 60. The fundamental signals from the angle logic circuits rotate the cutting blade into positions generally aligned with or tangent to the cutting path at each point along the path. Thus, the drive motors 34, 36 and 44 completely define the position of the cutting blade in the sheet material and the rate at which the cutting blade and material are fed relative to one another during the cutting operation.

FIG. 5 illustrates a problem which exists when lateral forces distributed along both sides of the cutting blade 20 are unbalanced. It will be appreciated that the net lateral force F generated by the interaction of the blade and sheet material along the depending end of the blade deflects or bends the blade to the phantom position. Without corrective action and regardless of the accuracy with which the servomechanisms locate the upper end of the blade, the blade will track a cutting path in the upper ply of the layup slightly different from the cutting path in the lower ply, and the pattern pieces from the respective plies will have slightly different shapes. Obviously, all pattern pieces should be identical and correspond to the programmed cutting path.

In practice, lateral or unbalanced forces on the cutting blade may be generated for a number of reasons. FIG. 6 illustrates the cutting blade 20 advancing in cutting engagement through woven sheet material at an angle to the fibers T and F. The parallel fibers T are shown transverse to the parallel fibers F but could have various geometric relationships, and other fibers could also be included in the weave. It will be observed that the fibers T having an acute angular relationship with the blade are pushed slightly to one side by the blade before they are cut. When the fibers are pushed, they exert a reacting force on the blade, and in a multi-ply layup of material, the sum of the forces can be substantial and produce the bending effect shown in FIG. 5. Similar effects are observed in knits and other materials. Factors which affect the phenomenon illustrated in FIG. 6 include the angular relationship between the cutting blade and fibers, the sharpening angle, blade sharpness, size and shape, and the strength of the fibers.

Another reason for unbalanced forces on the cutting blade is associated with the layup. Limp sheet material tends to provide weaker pressure or support on the side of the blade close to the edge of the layup or an opening within the layup such as a previous cut. For example, in FIG. 7, a cutting blade 20 is illustrated at successive positions along a cutting path P1 as the blade translates closely adjacent a previously made cut on the cutting path P2. In the vicinity of the previous cut along the cutting path P2, the sheet material between the paths can yield more easily, and reduce the lateral support at the side of the blade adjacent path P2. An unbalanced blade loading on the blade results and would deflect the blade unless corrective action is taken as illustrated in FIG. 7 and described more extensively below.

In accordance with the teachings of U.S. Pat. No. 4,133,235 referenced above, the unbalanced lateral loads applied to the blade 20 by the limp sheet material are detected and are used in the closed loop control of FIG. 2 to orient or yaw the knife blade slightly to the side of the cutting path from which the unbalanced load is applied. By orienting the blade in this manner, the unbalanced forces are opposed and are reduced, preferably to zero, as the blade advances. When the forces are reduced, blade bending and material shifting are also reduced, and the blade tracks the cutting path through the material as programmed more accurately.

In FIG. 2 a lateral load sensor 76 is connected with the knife blade 20 to detect the unbalanced lateral loads. The sensor provides a load signal which is fed back to the yaw correction circuits 100 in the $\theta$-command channel to yaw the blade in opposition the sensed loads.

One embodiment of the lateral load sensor 76 is illustrated in FIGS. 3 and 4. Mounted within the pressor foot is a circular mounting plate 80 that supports two guide rollers 82 and 84 disposed at opposite sides of the cutting blade 20 in rolling contact with the blade. Thus, the plate 80 maintains a fixed positional relationship laterally of the blade and tracks lateral motions of the blade.

A resilient mount 86 for the plate 80 is secured to the presser foot 50 by means of bolts 88 and 90 and includes two flexible arms 92 and 94 that are attached to diametrically opposite sides of the plate 80. The spring constant of the arms 92 and 94 is made relatively high so that the rollers 82 and 84 provide a degree of lateral rigidity to the cutting blade, but at the same time, permit limited lateral displacement of the blade under load. Thus, the displacements of the plate 80 are directly proportional to the loads applied to the blade and a position transducer 96 in the form of a linear variable differential transformer (LVDT) can serve as the lateral load sensor 76 in FIG. 2.

Fore and aft positioning of the blade is provided by a guide roller 120 at the flat rear edge and a yoke 122 connected to the support posts 52 and 54 and holding the roller.

It has been found from experience that the amount or degree of yaw correction required for a given force is not the same under all circumstances. In particular, when the cutting blade is travelling at a high rate of speed relative to the limp sheet material, higher lateral load levels exist. When the higher loads are fed back by the sensor 76 directly to the yaw correction circuits 100 a greater degree of yaw correction is produced than actually is warranted, and the $\theta$-motor 44 is overdriven. As an example, when the cutting blade travels at high rates of speed along generally straight contours of a pattern piece, the overdriving of the $\theta$-motor 44 causes the blade to produce a wavy cut rather than the programmed straight or gently curved cut.

To this end and in accordance with the present invention Applicants provide in the feedback circuit a variable gain amplifier 98 and gain adjustment means for adjusting the amplifier gain in accordance with the speed which the blade and material are fed relative to one another. The gain adjustment means illustrated in the embodiment of FIG. 2 is comprised by an X-tachometer 110, a Y-tachometer 112 and a computation circuit 114 which detect the speed at which the cutting blade 20 is advanced by the drive motors 34 and 36. In the embodiment of the control system in which motor pulses are transmitted from the displacement circuitry 60 to the X-axis driver 62, the pulses are applied to the X-tachometer 110 and the tachometer produces a voltage Ex proportional to the pulse repetition frequency or speed of the cutting blade along the X-coordinate axis. Similarly the Y-tachometer 112 measures the pulse repetition frequency of the Y-axis motor pulses and produces a voltage signal Ey proportional to the speed of the cutting blade along the Y-coordinate axis. The computation circuit 114 determines the resultant velocity of the cutting blade in accordance with the Pythagorean Theorem and the resultant signal from the circuit 114 is transmitted to the amplifier 98 for adjustment of amplifier gain.

Adjustment of gain of the amplifier 98 by the speed signal from the computation circuit 114 is made an inverse relationship with speed. In other words, the gain of the amplifier is reduced as the speed of the cutting blade increases. With the inverse relationship the load signal provided by sensor 76 has a decreasing effect as the feed rate of the blade and material increases, and consequently smaller yaw correction signals are generated by the correction circuit 100 at higher feed rates. Conversely, larger yaw correction signals are generated at low feed rates.

The inverse relationship reduces the sensitivity of the feedback circuit to loads at high feed rates and prevents overdriving of the $\theta$-drive motor in the forward loop. Wavy cuts along straight or gently curved cutting paths are avoided. At the same time proper gain is maintained at low speeds which are frequently employed for more difficult cuts where blade yawing in response to the sensed loads is a definite aid.

FIG. 8 is a diagram illustrating one exemplary linear inverse gain-speed relationship. At low speeds the gain of the amplifier 98 is a maximum or 100%, and that gain gradually and proportionally decreases as speed increases. When the speed reaches a predetermined value, S1, the gain is reduced entirely to zero. Under these circumstances the yaw correction circuit is operative at speeds below S1, and is effectively turned off above that speed.

FIG. 9 illustrates another exemplary inverse gain-speed relationship that retains some degree of yaw correction throughout the full range of cutting speeds. At low speeds less than S2, the amplifier 98 operates at its maximum gain without change. As speeds are increased in the range between S2and S3 the gain decreases proportionally to a residual level at 10% of its maximum. At speeds above S3, the amplifer holds the residual gain level.

Of course, still other types of gain relationships both linear and non-linear may be employed.

In summary, the present invention relates to a closed loop control for the cutting machine 10 in which yaw correction signals applied to the cutting blade 20 are a function of not only the lateral loading applied to the blade but also the speed at which the blade is fed relative to the limp sheet material.

While the present invention has been described in a preferred embodiment, it should be understood that numerous modifications and substitutions can be had without departing from the spirit of the invention. For example, the tachometers 110 and 112 and computation circuit 114 of the gain adjustment means merely illustrate one method by which the speed parameter can be derived to adjust the gain of amplifier 98. Other means of derivation can be employed or the speed signal may be obtained directly from signals applied to the displacement logic circuitry 60 from the program tape 16. The invention also has particular utility with cutting machines such as the machine 10 which has a penetratable vacuum bed 24. The existence of a vacuum within the sheet material being cut increases the signal-to-noise ratio of the signal derived from the load sensor 76 and thus provides a clearer feedback signal for amplification and increased response at low feed rates. Accordingly, the present invention has been described in a preferred embodiment by way of illustration rather than limitation.

We claim:

1. A method of cutting limp sheet material with a cutting blade comprising:

advancing the cutting blade and sheet material relative to one another in cutting engagement and generally tangent to a desired cutting path;

sensing lateral loads applied to the blade by the sheet material as the blade is advanced;

orienting the blade slightly out of a position tangent to the cutting path as the blade is advanced to oppose the lateral loads applied to the blade; and regulating the amount by which the blade is oriented out of the tangent position in accordance with the sensed lateral load on the blade and an adjustable gain factor influencing the effect of lateral load on blade orientation; and adjusting the gain factor as the blade advances in accordance with the rate at which the blade and material are advanced relative to one another.

2. A method of cutting limp sheet material as defined in claim 1 wherein the step of adjusting includes decreasing the gain factor to reduce the amount by which the blade is oriented out of the tangent position at a given lateral load as the rate of advancement increases.

3. A method of cutting limp sheet material as defined in claim 1 wherein the cutting blade is a cantilever-mounted knife blade.

4. A method of cutting limp sheet material as defined in claim 1 wherein the step of regulating comprises regulating the amount by which the blade is oriented in direct relationship with the sensed lateral load and the step of adjusting comprises adjusting the gain factor in inverse relationship with the rate of advancement.

5. A method of cutting limp sheet material as defined in claim 1 wherein the step of advancing comprises advancing a rigid cantilever-mounted knife blade along a cutting path relative to the sheet material in cutting relationship; and the step of orienting comprises orienting the advancing knife blade toward the side of the cutting path from which a lateral load bending the cantilevered knife blade is applied.

6. A method of cutting limp sheet material as defined in claim 5 wherein:

the step of advancing comprises advancing the rigid, cantilever-mounted knife blade along a cutting path through a multi-ply layup of limp sheet material with depending portion of the blade in the layup whereby forces from the layup are developed on the depending portion of the blade.

7. A method of cutting limp sheet material as defined in claim 6 further including the step of evacuating air from the layup of sheet material in the region being cut during the steps of advancing and sensing.

8. A method of cutting limp sheet material with a cutting blade in an automatically controlled cutting machine comprising:

advancing the cutting blade and sheet material relative to one another in cutting engagement and generally tangent to a desired cutting path in the material;

sensing lateral loads applied to the blade by the sheet material as the blade is advanced and producing load signals representative of the sensed lateral loads on the cutting blade;

amplifying the sensed lateral load signals with an adjustable gain factor;

adjusting the gain factor upwardly and downwardly in inverse relationship with the rate of advancement of the cutting blade and sheet material; and orienting the cutting blade out of the tangent position by an amount determined by the amplified load signal.

* * * * *